US005682191A

United States Patent [19]

Barrett et al.

[11] Patent Number: 5,682,191

[45] Date of Patent: Oct. 28, 1997

[54] INK JET PRINTING APPARATUS HAVING MODULAR COMPONENTS

[75] Inventors: Douglas John Barrett, Westford, Mass.; Scott Burnett, Derry, N.H.; Carlos Alberto Gomez, Framingham, Mass.

[73] Assignee: Iris Graphics Inc., Bedford, Mass.

[21] Appl. No.: 185,508

[22] Filed: Jan. 24, 1994

[51] Int. Cl.[6] ..... B41J 2/01

[52] U.S. Cl. ..... 347/104; 347/73; 347/90; 347/108; 347/27; 206/49; 346/134; 271/145

[58] Field of Search ..... 347/73, 74, 27, 347/28, 77, 90, 104, 108; 242/530.2, 594.3; 206/389, 409, 412; 355/311; 346/134; 271/145

[56] References Cited

U.S. PATENT DOCUMENTS

| | | | |
|---|---|---|---|
| 1,765,417 | 6/1930 | Bombard | 206/409 |
| 4,031,561 | 6/1977 | Paranjpe | 347/28 |
| 4,321,608 | 3/1982 | Kaneko | 347/77 |
| 4,360,817 | 11/1982 | Araway et al. | 347/90 |
| 4,384,295 | 5/1983 | Lewis et al. | 347/77 |
| 4,800,396 | 1/1989 | Hertz | 346/1 |
| 4,849,769 | 7/1989 | Dressler | 347/27 |
| 4,879,565 | 11/1989 | Fujii | 347/90 |
| 4,989,801 | 2/1991 | Thomas et al. | 206/409 |
| 5,160,938 | 11/1992 | Fargo | 346/1 |
| 5,276,527 | 1/1994 | Sugiyama et al. | 347/134 |

FOREIGN PATENT DOCUMENTS

| | | | |
|---|---|---|---|
| 0518674 | 12/1992 | European Pat. Off. | 347/104 |
| 3405164 | 8/1985 | Germany | 347/86 |
| 60-2369 | 1/1985 | Japan | 347/7 |
| 60-86559 | 5/1985 | Japan | 355/311 |
| 4-176659 | 6/1992 | Japan | 347/86 |

*Primary Examiner*—John E. Barlow, Jr.
*Attorney, Agent, or Firm*—Darby & Darby

[57] ABSTRACT

Ink jet printing apparatus including a printing substrate cassette containing a multiplicity of printing substrates in rolled cut sheet form, an ink jet head assembly operative to print on a printing substrate and an ink supply assembly operative to provide ink to the ink jet head assembly.

22 Claims, 14 Drawing Sheets

Fig. 6
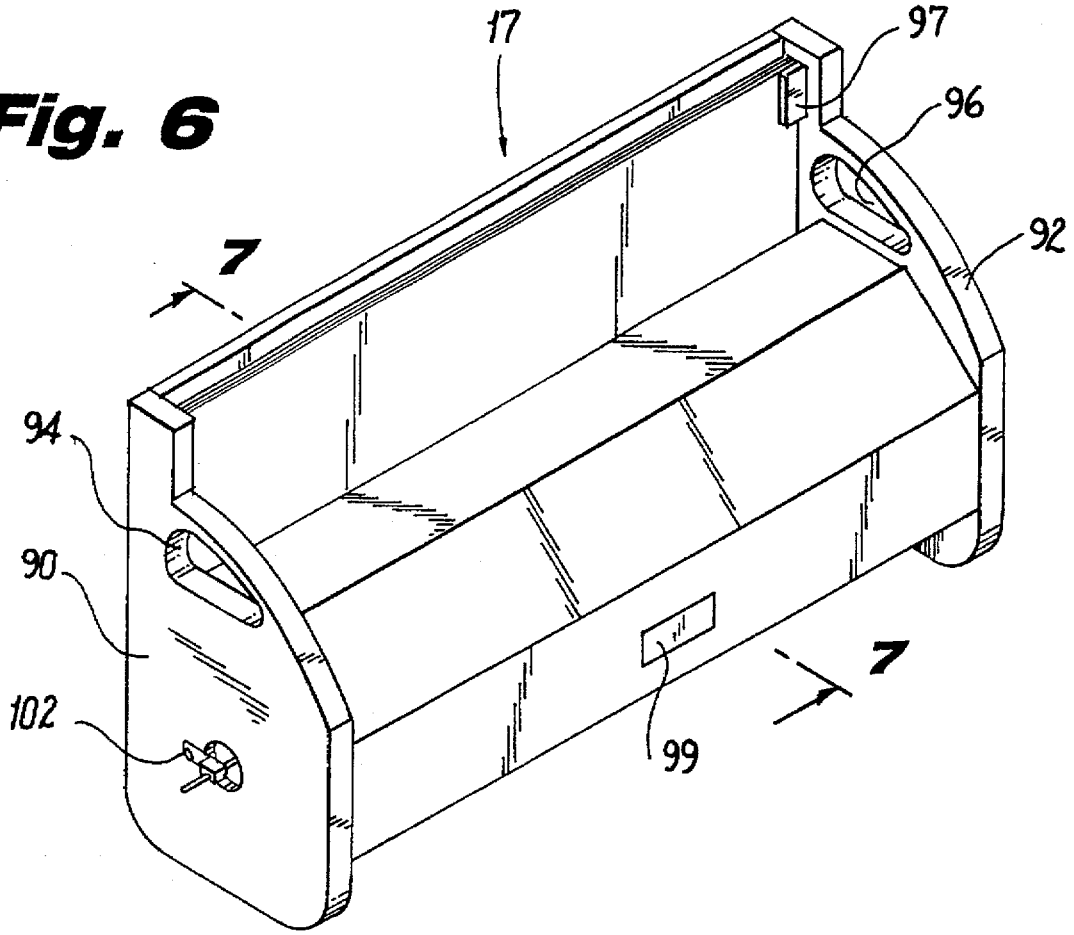
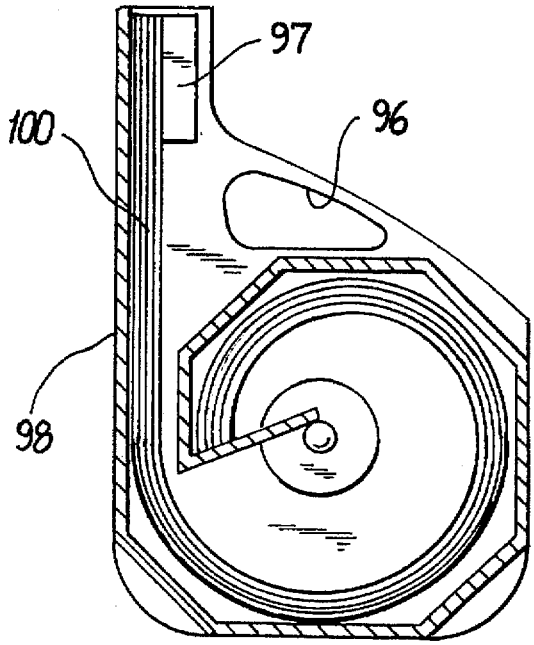
Fig. 7

Fig. 9
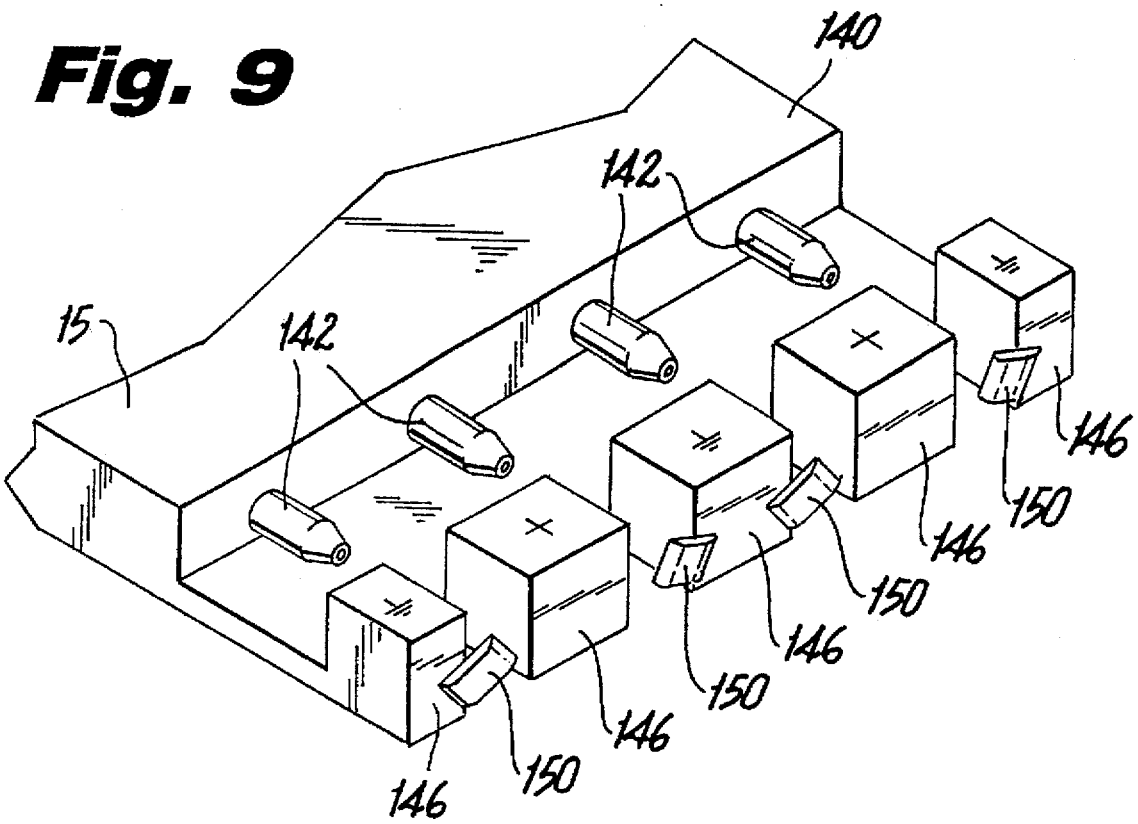
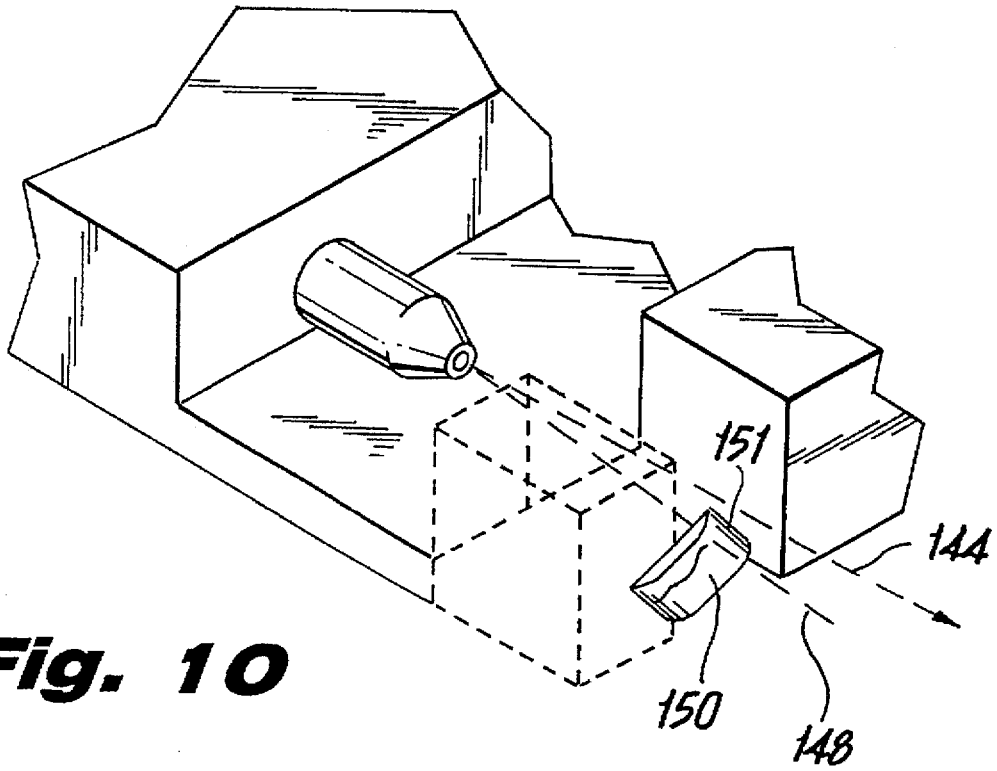
Fig. 10

INK JET PRINTING APPARATUS HAVING MODULAR COMPONENTS

FIELD OF THE INVENTION

The present invention relates to ink jet printing and more particularly to continuous ink jet printing.

BACKGROUND OF THE INVENTION

A great variety of ink jet printers are known in the art and in the patent literature. The following U.S. Patents and the references cited therein are believed to be representative of the state of the art:

U.S. Pat. No. 4,800,396 describes a compensation method and device for ink droplet deviation of an ink jet and illustrates the use of side by side deflection electrodes. U.S. Pat. No. 5,160,938, to some of the present inventors, describes a method and means for calibrating an ink jet printer.

SUMMARY OF THE INVENTION

The present invention seeks to provide an ink jet printer which is economical and easy to use and maintain and which provides extremely high quality printed output.

There is thus provided in accordance with a preferred embodiment of the present invention ink jet printing apparatus including:

- a generally cylindrical printing substrate support;
- a printing substrate cassette containing a multiplicity of printing substrates in rolled cut sheet form;
- an ink jet head assembly operative to print on a printing substrate; and
- an ink supply assembly operative to provide ink to said ink jet head assembly.

The ink jet head assembly may print directly onto the printing substrate or via an intermediate transfer member.

Preferably, the ink jet printing apparatus also includes a loading assembly for automatically loading a printing substrate from said printing substrate cassette onto the printing substrate support. Manual loading of a printing substrate is also possible using the loading assembly either via the cassette or otherwise.

Additionally, the ink jet printing apparatus preferably includes a cleaning assembly for automatically cleaning the ink jet head assembly.

Further in accordance with a preferred embodiment of the present invention the ink jet printing apparatus preferably also includes waste collecting apparatus including vacuum generating apparatus.

Additionally in accordance with a preferred embodiment of the invention, the ink jet printing apparatus also includes out of ink sensing apparatus and apparatus for automatically calibrating the ink jet head assembly.

Further in accordance with a preferred embodiment of the present invention there is provided an ink jet head assembly comprising:

- a plurality of ink jet nozzles, and
- attachment apparatus for mechanically fixing the plurality of ink jet nozzles to a base, so as to substantially prevent relative mechanical displacement therebetween.

The ink jets may each output an ink of a different color. Alternatively, they may all output ink of the same color. The outputs may be all of the same density or of different densities.

Additionally in accordance with a preferred embodiment of the present invention there is provided an ink jet head assembly including a plurality of ink jets and a deflection assembly comprising electrodes shared by a pair of adjacent ink jets.

Further in accordance with a preferred embodiment of the present invention there is provided an ink jet head assembly including a plurality of ink jets producing a plurality of horizontally extending drop streams, a deflection assembly comprising a drop charging tunnel for each of the plurality of generally horizontally extending drop streams and a deflection electrode arranged between each pair of adjacent ones of said plurality of horizontally extending drop streams in a horizontal plane, such that in a horizontal plane, alongside each horizontally extending drop stream there are present a pair of electrodes.

Preferably at least some of the displacement electrodes serve simultaneously for deflection of more than one drop stream.

Further in accordance with a preferred embodiment of the invention, a drop collector is also provided and has a machined ceramic knife edge.

In accordance with a preferred embodiment of the present invention, the cleaning assembly includes an ultrasonic cleaning bath in which deflection electrodes are located.

Preferably, the charge tunnel, knife edge and nozzle tip all are located in the ultrasonic cleaning bath simultaneously.

Additionally in accordance with a preferred embodiment of the present invention, the drop collector includes an inclined knife edge impinging on the horizontal drop stream and defining an edge which is slanted in a plane perpendicular to the stream, whereby vertical adjustment of the position of the knife automatically produces horizontal adjustment thereof.

Further in accordance with a preferred embodiment of the present invention, the ink supply assembly comprises a flexible ink container including a septum filter for filtering ink removed therefrom.

Additionally in accordance with a preferred embodiment of the present invention, the flexible ink container includes an active component for identifying the contents of the container.

BRIEF DESCRIPTION OF THE DRAWINGS

The present invention will be understood and appreciated more fully from the following detailed description,taken in conjunction with the drawings in which:

FIG. 6 is a pictorial illustration of a rolled sheet cassette useful in accordance with a preferred embodiment of the present invention;

FIG. 7 is a sectional illustration of the cassette of FIG. 6, taken along the lines VII—VII in FIG. 6;

FIG. 9 is a simplified illustration of part of an ink jet printhead constructed and operative in accordance with a preferred embodiment of the present invention;

FIG. 10 is a simplified illustration of the operation of the printhead of FIG. 9;

DETAILED DESCRIPTION OF A PREFERRED EMBODIMENT

Figure 1:
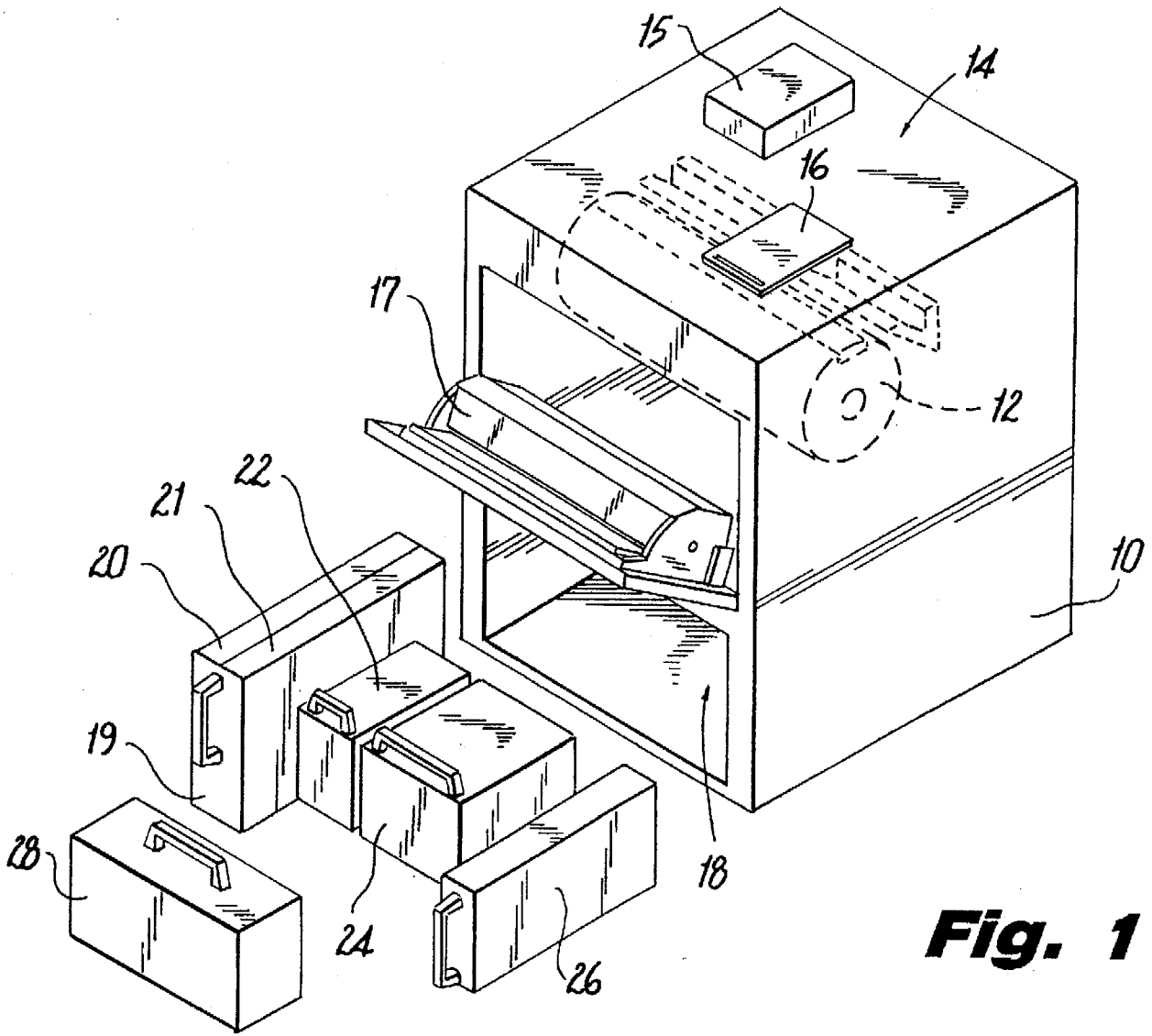
FIG. 1 is a simplified illustration of ink jet printing apparatus constructed and operative in accordance with a preferred embodiment of the present invention.

Reference is now made to FIG. 1 which is a simplified, partially exploded, illustration of ink jet printing apparatus constructed and operative in accordance with a preferred embodiment of the present invention. The apparatus of FIG. 1 includes a housing 10 inside which are disposed a drum assembly 12, a printhead assembly 14, including a printhead module 15 and a printhead carriage 16, and a cassette 17 holding sheets of paper or other printing substrate.

Disposed in a compartment 18 underneath drum assembly 12 are a plurality of modules including a power and CPU module 19 including a CPU module 20 and a power control circuitry module 21 for the overall system, a waste/vacuum module 22, including a pump, and associated valves and electronics, an ink pump module 24, typically including four ink pumps and associated electronics and a power supply and cooling fan module 26.

Disposed forward of modules 22 and 24 is a liquid consumables module 28, which will now be described with reference to FIG. 2.

Figure 2:
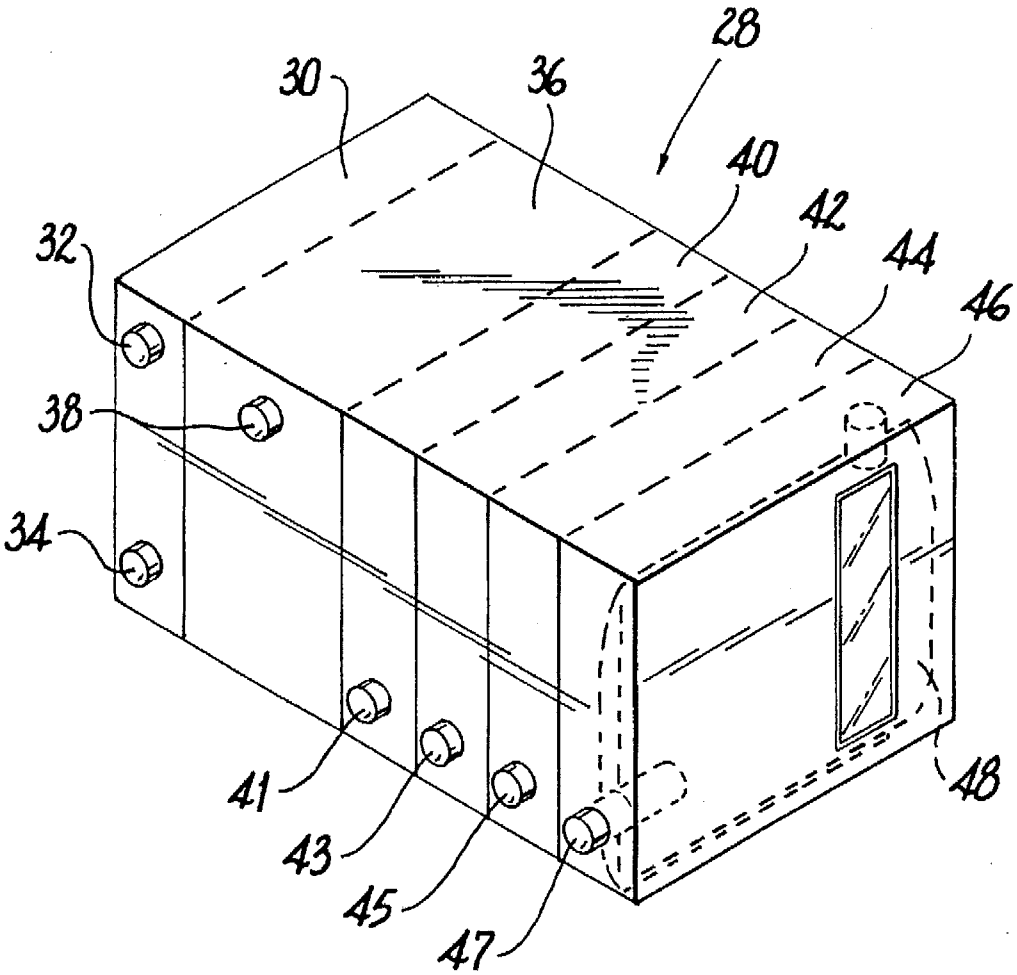
FIG. 2 is a simplified illustration of a fluid storage bank useful in the apparatus of FIG. 1.

Reference is now made to FIG. 2 which is a simplified illustration of a liquid consumables storage bank useful in the apparatus of FIG. 1. Preferably the liquid consumables storage bank 28 comprises a cardboard container which may have a plurality of subdivisions and preferably includes a plurality of flexible fluid containers of conventional construction, which may be of the type illustrated in FIG. 3.

In accordance with a preferred embodiment of the present invention, the liquid consumables storage bank 28 includes a cleaning fluid container 30 having an inlet 32 and an outlet 34 for circulating cleaning fluid therethrough. The liquid consumables storage bank 28 also preferably includes a waste pouch 36 having a septum equipped inlet 38. Bank 28 also preferably includes at least four ink pouches 40, 42, 44 and 46, typically including black, yellow magenta and cyan inks, having septum equipped filter outlets 41, 43, 45 and 47 respectively.

In another preferred embodiment of the invention the four ink pouches 40, 42, 44 and 46 may all include one color with same or different densities. Bank 28 may be formed with fully or partially translucent or transparent side walls to enable the ink level in the ink pouches to be inspected visually.

Figure 3:
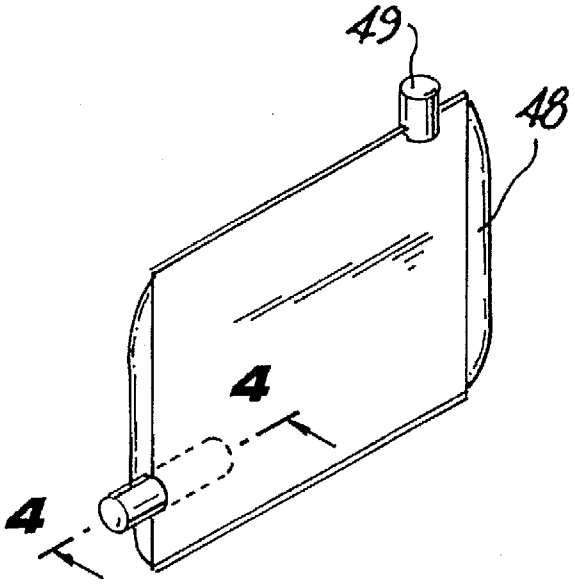
FIG. 3 is a simplified illustration of part of a fluid storage unit employed in the apparatus of FIGS. 1 & 2.

Reference is now made to FIG. 3, which is a simplified illustration of a flexible container 48 forming part of the liquid storage unit employed in the apparatus of FIGS. 1 & 2 as an ink pouch. It is seen that the flexible container 48 is preferably equipped with a septum filter arrangement as shown in FIG. 4 and a fill tube 49.

Figure 4:
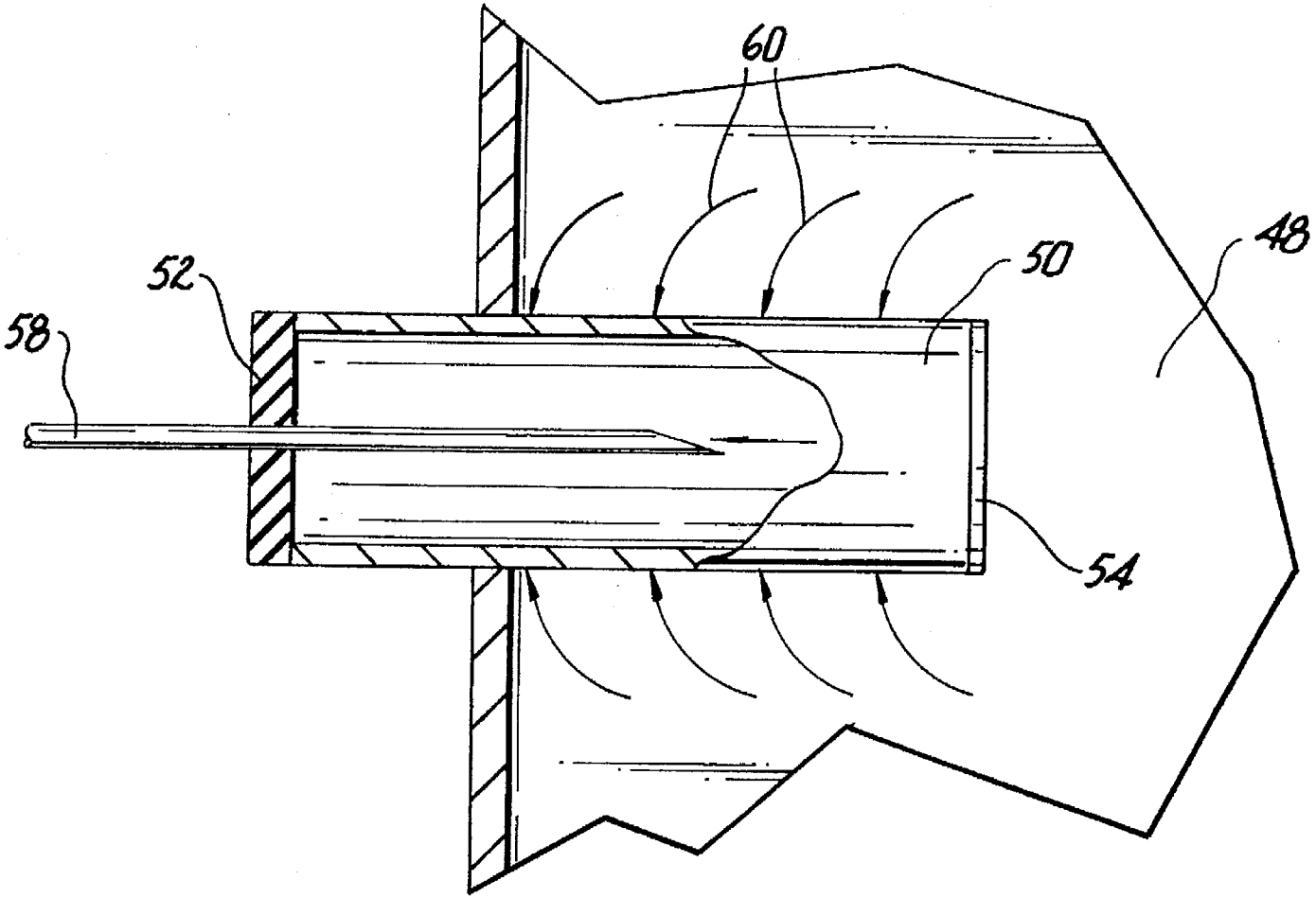
FIG. 4 is an illustration taken along the lines IV—IV in FIG. 3 which illustrates removing liquid from the storage unit of FIG. 3.

As seen in FIG. 4, the flexible container 48 includes a cylindrical filter 50 having a septum 52 and a cap 54 at its respective ends. Filling of the container, which normally occurs only at the factory, is accomplished via fill tube 49 (FIG. 3) which is subsequently sealed. As seen in FIG. 4, liquid, such as ink, is drawn out of the container by means of a needle 58 which passes through septum 52 but does not extend to cap 54, thus requiring all of the ink to pass through cylindrical filter 50, as indicated by arrows 60. When flexible container 48 is used as a cleaning fluid container, filter 50 is operative to trap contaminants which may have been flushed from within the print head.

Preferably, the flexible container 48 has active or passive contents coding apparatus, such as a bar code label or code generator, which is operative to indicate to printing apparatus 10 of FIG. 1 and thus to an operator, the type and quantity of ink contained in the container 48. The coding apparatus may be employed for preventing reuse of the cassette, by providing a count-down output code, corresponding to the amount of ink remaining in the container, which is not resettable by a user. The coded information provided by the coding apparatus is typically sensed by a conventional code reader (not shown) forming part of printing apparatus 10 of FIG. 1 and mounted in code receiving communication with the coding apparatus.

Figure 5:
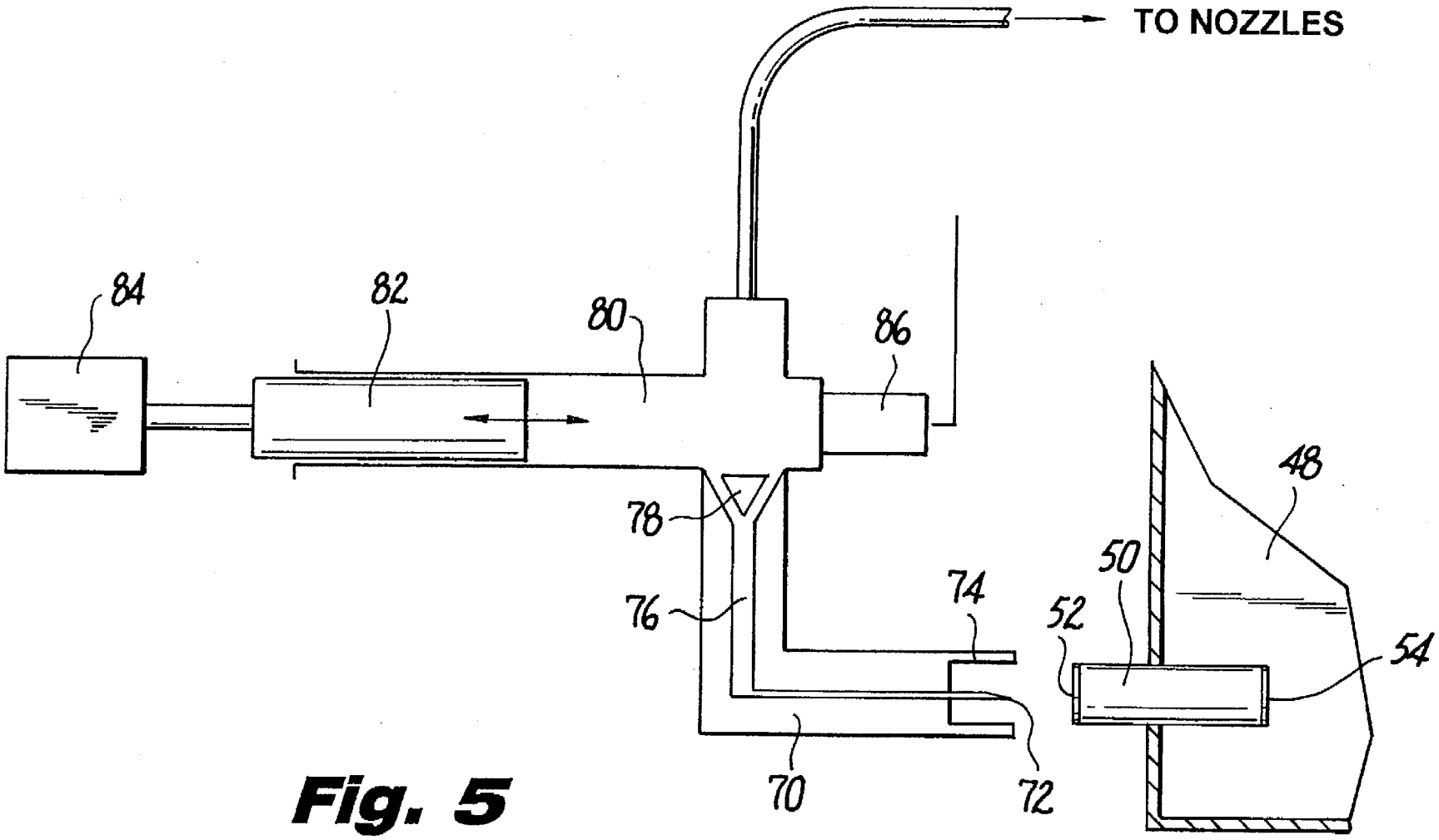
FIG. 5 is a simplified illustration of an ink flow assembly defining a fluid flow path extending from an ink supply unit to an ink jet nozzle in accordance with a preferred embodiment of the present invention.

Reference is now made to FIG. 5, which is a simplified illustration of an ink flow assembly defining a fluid flow path extending from an ink supply unit to an ink jet nozzle in accordance with a preferred embodiment of the present invention. An ink pouch connector portion 70 including a needle 72 and a protective enclosure 74 is arranged for engagement with an ink pouch in a manner illustrated in FIG. 4. Needle 72 communicates with an ink flow pathway 76 which is equipped with a one-way valve 78, preventing back flow to the pouch. Alternatively or additionally, the pouch may be equipped with a one-way valve.

Ink flow pathway 76 communicates via valve 78 with a pumping chamber 80 in which a piston 82 travels reciprocally, being driven by an appropriate motor 84. Ink is pumped directly to ink jet nozzles in a printhead which will be described hereinbelow. A pressure transducer 86 senses the absence of ink in pumping chamber 80 and provides an OUT OF INK indication to appropriate circuitry in the system for terminating operation of the device and alerting an operator. Alternatively, the pressure transducer 86 may be associated with each pouch. Pressure transducer 86 may also be operative to monitor ink pressure as ink is pumped to nozzles in the print head.

Reference is now made to FIGS. 6 and 7 which illustrate a rolled sheet cassette 17 useful in accordance with a preferred embodiment of the present invention. The cassette is preferably formed of a pair of end portions 90 and 92, each having an integrally formed handle aperture, 94 and 96 respectively. A sheet of cardboard or plastic, or alternatively any other suitable material is bent at several width lines to form, together with end portions 94 and 96, a generally coiled cylindrical enclosure 98 in which are disposed a multiplicity of cut sheets of paper or other substrate 100 in a rolled orientation. One edge of the sheets of paper or substrate is exposed for automatic feeding onto a drum as will be described hereinbelow.

The cassette 17 is preferably held together by joining end portions 94 and 96 together by means of a cable tie 102 or any other tensioned member, which may extend therebetween interior of the rolled sheets of paper. The cassette is preferably formed with a built-in, integrally formed, spring loaded, corner separator 97. Preferably, the cassette has active or passive contents coding apparatus 99, such as a bar code label or code generator, which is operative to indicate to printing apparatus 10 of FIG. 1 and thus to an operator, the type and quantity of the paper contained in the cassette 17. The coding apparatus 99 may be employed for preventing reuse of the cassette, by providing a count-down output code, corresponding to the number of sheets remaining in the cassette, which is not resettable by a user. The coded information provided by coding apparatus 99 is typically sensed by a conventional code reader (not shown) forming part of printing apparatus 10 of FIG. 1 and mounted in code receiving communication with apparatus 99.

Manual loading may be achieved either by inserting substrate sheets into the cassette by hand or by feeding them to the printing apparatus 10 of FIG. 1 by the same pathway as used for automatic loading, such as shown in FIGS. 8A–8D, or by an alternative pathway.

Reference is now made to FIGS. 8A–8D which illustrate four stages in the operation of an automatically loading and unloading substrate support constructed and operative in accordance with a preferred embodiment of the present invention.

The automatically loading and unloading substrate support comprises a generally circular cylindrical drum 120 having an elongate surface insert 122 onto which are pivotably mounted respective elongate leading edge and trailing edge clamps 124 and 126.

Figure 8A:
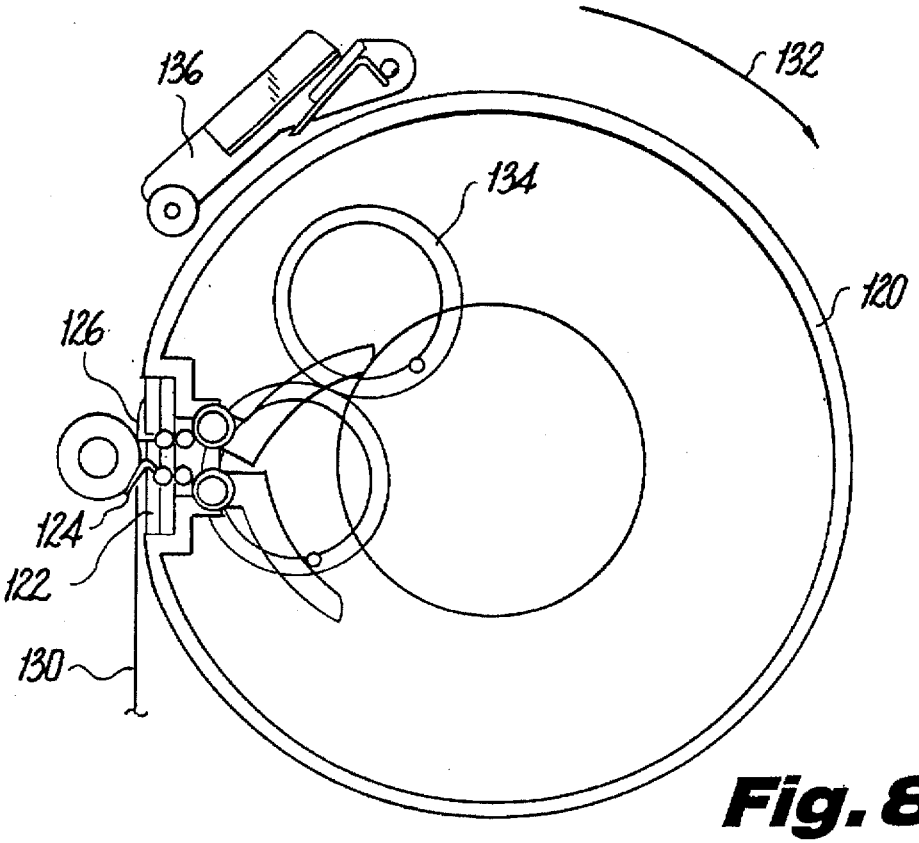
FIGS. 8A, 8B, 8C and 8D are illustrations of four stages in the operation of an automatically loading and unloading substrate support constructed and operative in accordance with a preferred embodiment of the present invention.
Figure 8B:
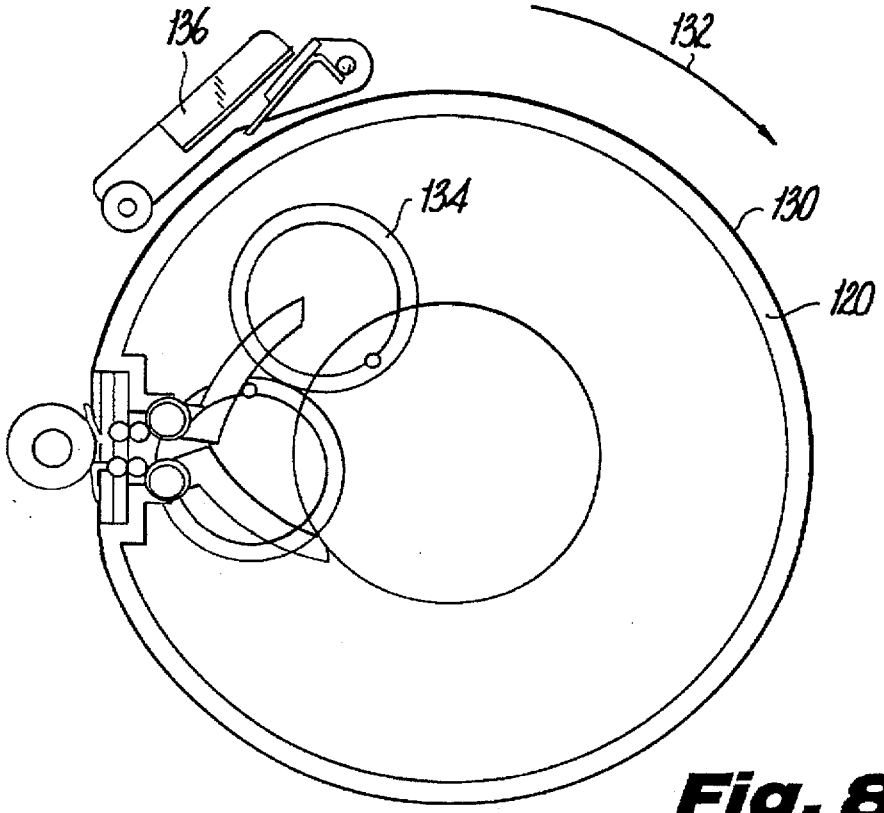

As seen in FIG. 8A, paper 1e leading edge of a sheet of paper 130 from cassette 17 (FIG. 1) is brought into engagement with leading edge clamp 124, rotation of the drum 120 in a direction indicated by an arrow 132 causes the clamp 124 to be rotated so as to hold the paper 130 and continued rotation of the drum in the same direction causes the paper 130 to be wound around the drum until the trailing edge of the paper 130 lies in engagement with trailing edge clamp 126 and is subsequently held by rotation of clamp 126. Closing of clamps 124 and 126 is normally caused by spring loading thereof which urges them into a closed orientation. Opening of clamps 124 and 126 is produced by a cam driven lever assembly 134.

Figure 8C:
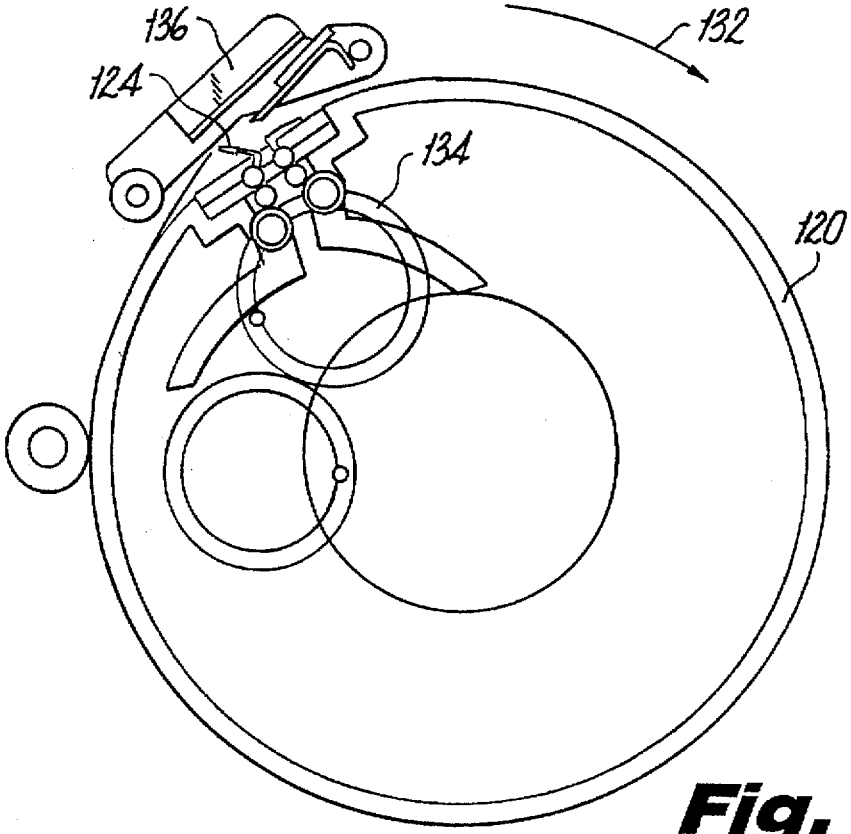
Figure 8D:
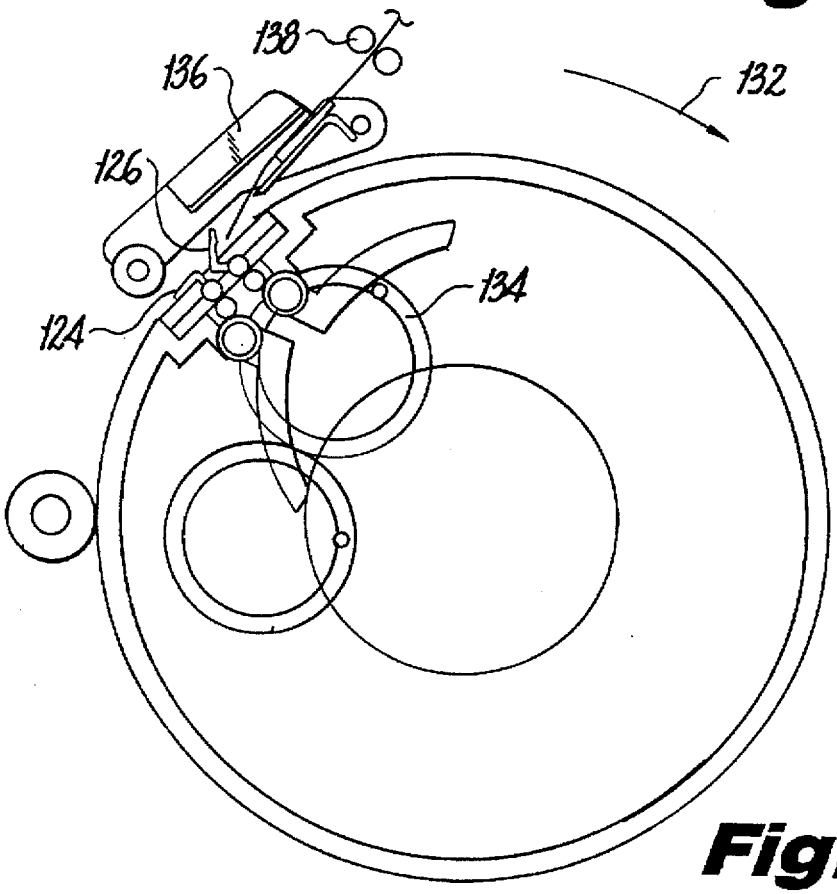

Reference is now made to FIGS. 8C and 8D which illustrate automatic removal of paper from the drum 120. When the paper is to be removed from drum 120, leading edge clamp 124 is rotated so as to release the leading edge of the paper 130. Continued rotation of the drum 120 in the direction indicated by arrow 132 causes the leading edge of the paper 130 to engage a paper removal assembly 136 and eventually to be drawn by associated paper drive rollers 138, as seen in FIG. 8D. The trailing edge clamp 126 is opened to release the paper.

Reference is now made to FIGS. 9 and -10, which illustrate the printhead module 15 of FIG. 1 constructed and operative in accordance with a preferred embodiment of the present invention. The printhead module 15 preferably comprises a base 140 onto which are precisely mounted a plurality of ink jet nozzles 142, which are coupled to ink supplies as by the apparatus of FIG. 3, described hereinabove.

Each of nozzles 142 provides a stream of droplets along a flowpath, indicated by an arrow 144 in FIG. 10. The droplets are charged in a conventional manner by charging apparatus (not shown) and pass between adjacent side by side deflection electrodes 146 which are operative to selectably and information-wise deflect the droplets from each of the nozzles into a deflected flowpath, indicated by an arrow 148 in FIG. 10.

Disposed between each pair of adjacent deflection electrodes 146 and preferably mounted thereon is a deflected drop catcher 150 which is operative to catch deflected drops and prevent them from reaching the paper. In accordance with a preferred embodiment of the present invention, the deflected drop catcher 150 defines an inclined knife edge surface 151, preferably formed by machining a ceramic material, which is inclined with respect to the horizontal and lies preferably in a plane perpendicular to the undeflected stream indicated by arrow 144.

By employing side by side deflection electrodes and an inclined deflected drop catcher, vertical adjustment of the position of the inclined knife edge automatically produces corresponding horizontal adjustment of the deflection threshold defined thereby.

It is noted that the printhead is not designed to be mechanically adjustable. All calibration and adjustment thereof is achieved electronically by controlling the operation of the charging apparatus and the deflection electrodes. It is to be noted that a single deflection electrode may operate simultaneously for deflection of two droplet streams on both adjacent sides thereof.

Figure 11:
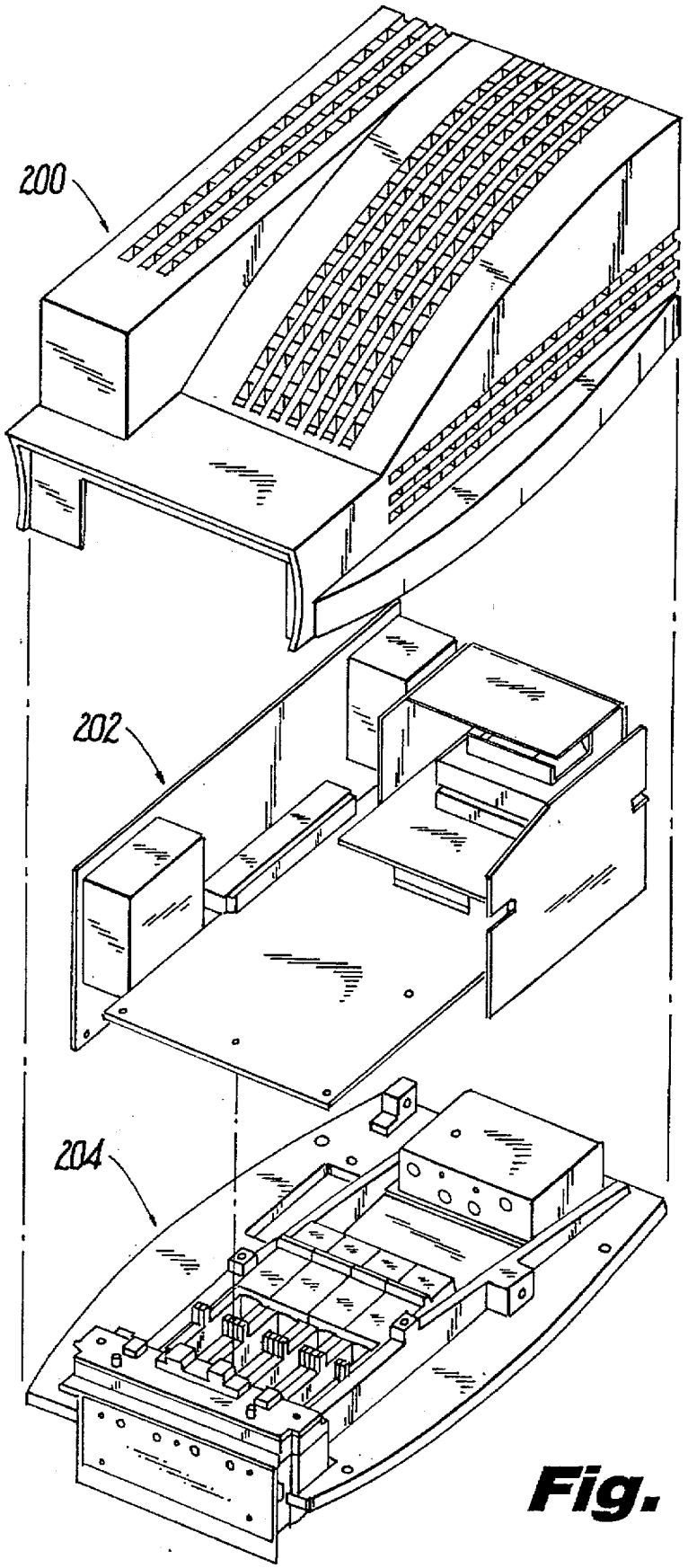
FIG. 11 is an intermediate detail exploded view illustration of a printhead assembly constructed and operative in accordance with a preferred embodiment of the present invention.
Figure 12:
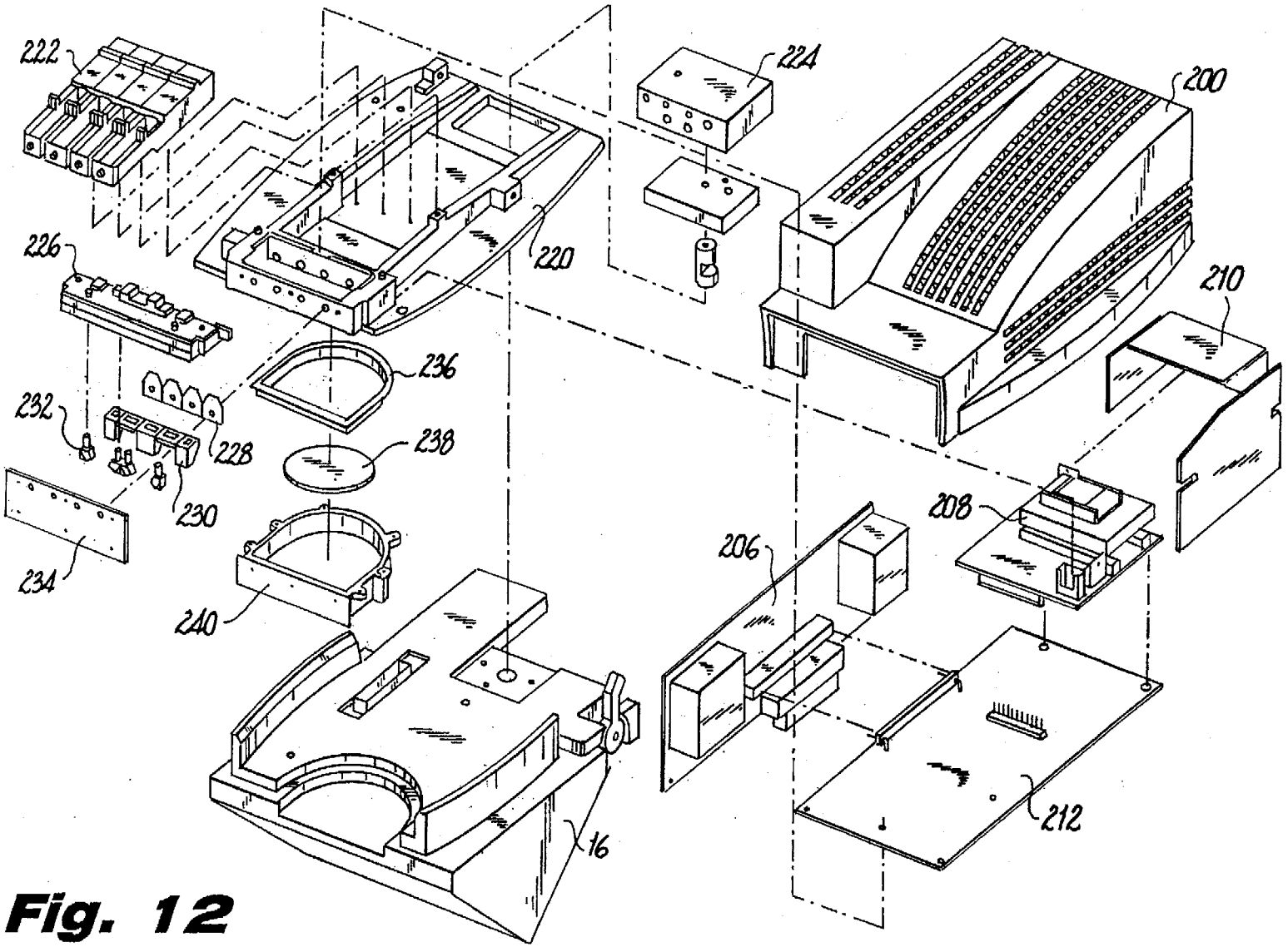
FIG. 12 is a more detailed exploded view illustration of the printhead assembly of FIG. 11.

Reference is now made to FIGS. 11 and 12 which illustrate a printhead assembly constructed and operative in accordance with a preferred embodiment of the present invention. Generally as illustrated in FIG. 11, the printhead assembly includes a ventilated cover 200, an electronics subassembly 202 and a mechanical and fluid flow subassembly 204.

Turning now specifically to FIG. 12, it is seen that the electronics subassembly 202 preferably comprises a high voltage nozzle deflection electronics PC board assembly 206 and an ultrasound driver assembly 208 and associated heat sinks 210, all mounted on a nozzle electronics PC board 212.

The mechanical and fluid flow subassembly 204 comprises a head base 220 onto which are mounted nozzle assemblies 222 and an ink block assembly 224. A deflection structure assembly is also mounted onto head base 220 and includes a deflection structure base 226, charge tunnels 228, deflection electrodes 230, knife edge assemblies 232 and a mist bib 234.

A liquid bath for the nozzles and the deflection assembly 226 is defined by a pan 236 with which is associated an ultra sound crystal 238, driven by driver assembly 208. Both pan 236 and crystal 238 are enclosed by a cover member 240. The entire assembly described above is modularly and removably mounted onto print head carriage 16. This arrangement enables printheads having different colors or other characteristics to be easily and quickly interchanged.

Figure 13:
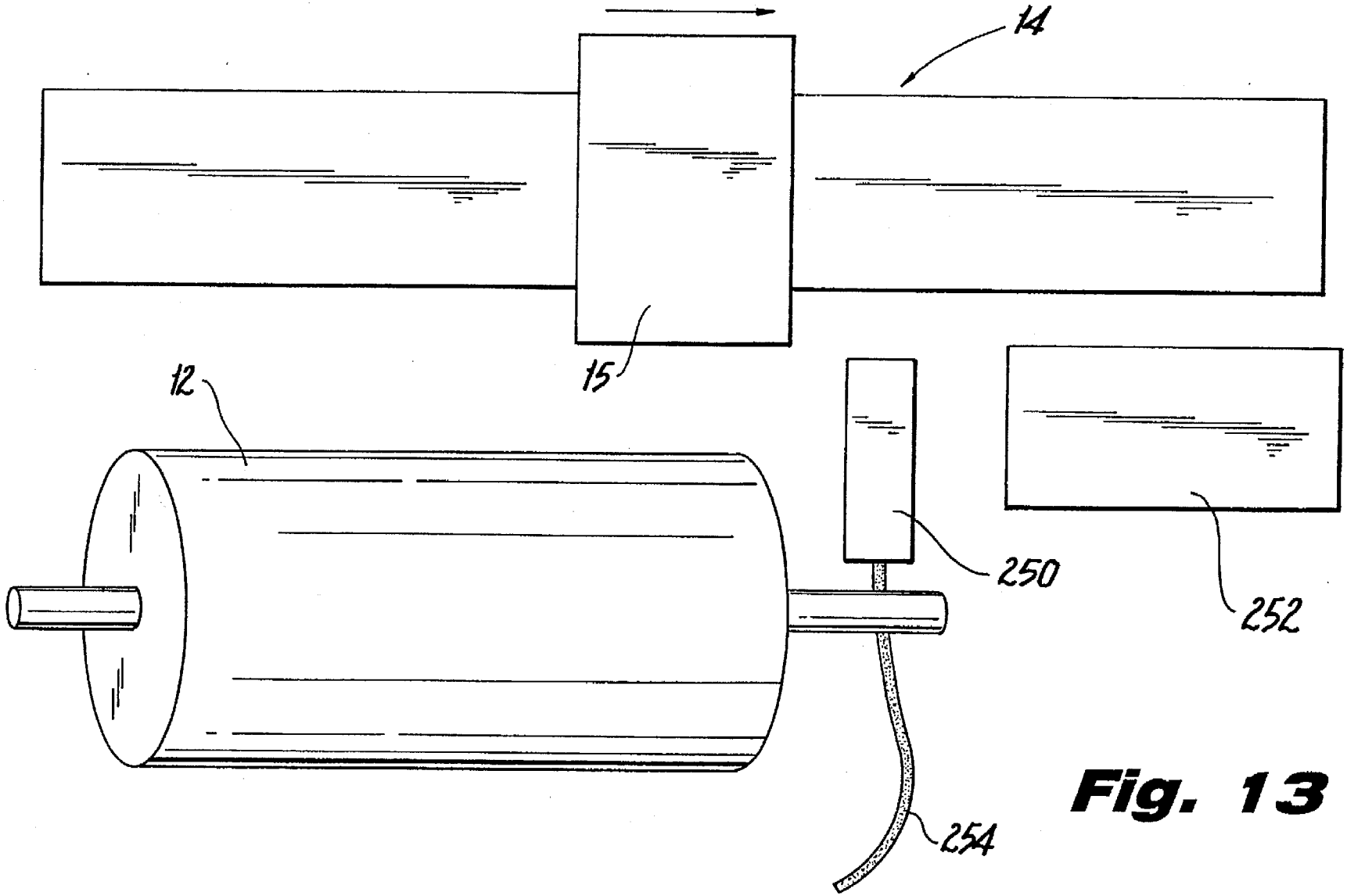
FIG. 13 is a concept level illustration of apparatus for cleaning and calibrating a printhead in accordance with a preferred embodiment of the present invention.

Reference is now made to FIG. 13, which illustrates the general orientation of a printhead face cleaner 250 and a target block 252 alongside drum 12 and facing printing head assembly 14. Face cleaner 250 is operative to apply a vacuum to the face of printhead 15 after printing, to remove residues therefrom and is coupled via a vacuum line 254 to waste vacuum module 22 (FIG. 1).

Figure 16:
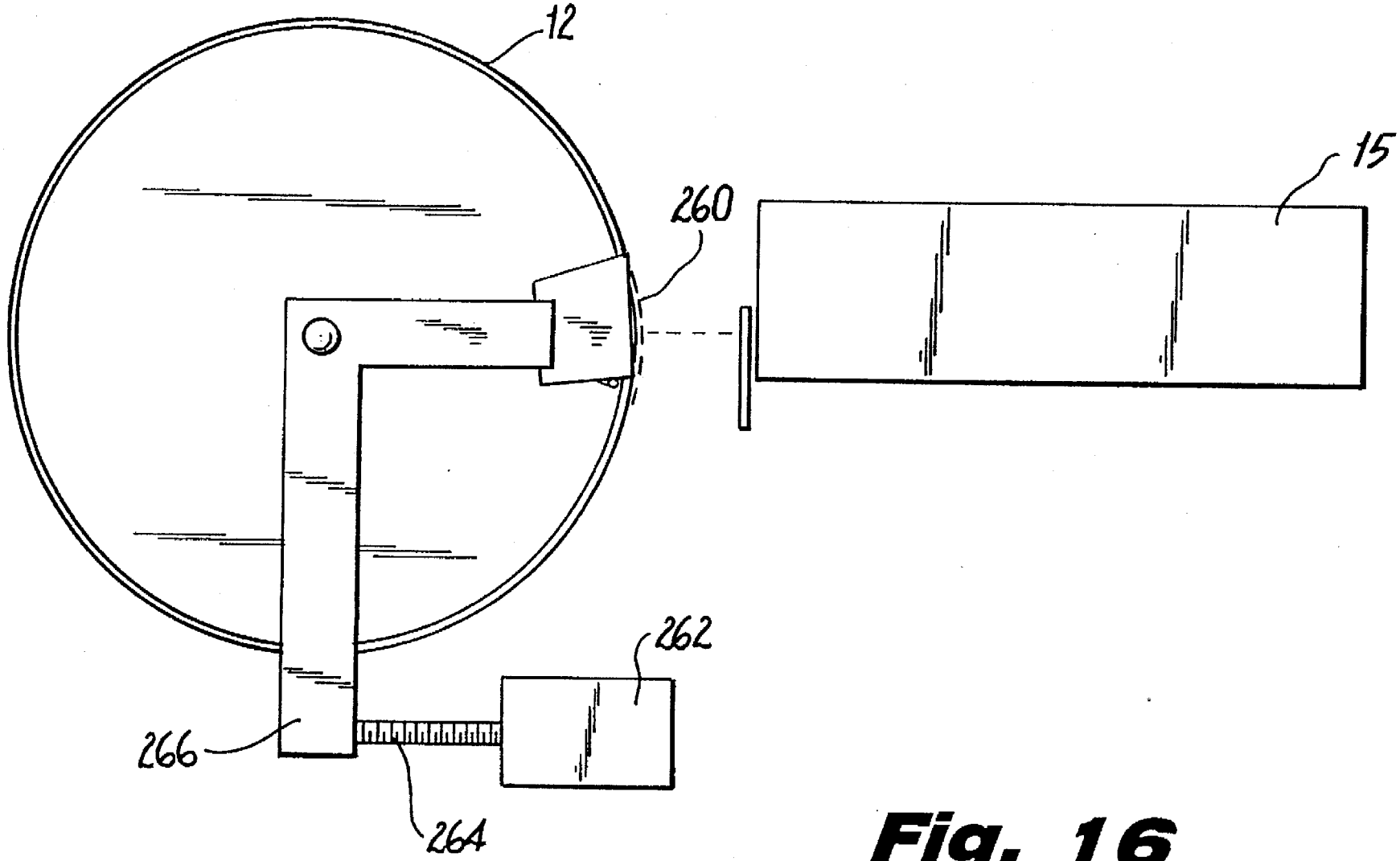
FIG. 16 is a concept level illustration of target block calibration apparatus constructed and operative in accordance with a preferred embodiment of the present invention.

The target block 252 is illustrated in greater detail in FIG. 16 to which reference is also made. The structure and operation of the target block 252 is essentially as described in U.S. Pat. 5,160,938 of the present assignee, the disclosure of which is hereby incorporated by reference. In the preferred embodiment of FIG. 16, a calibration needle 260 is displaced in rotary motion tangent to the surface of drum 12 by a motor 262 and associated screw drive 264, which drives a needle mount arm 266 which is coaxially mounted with the drum 12.

Figure 14:
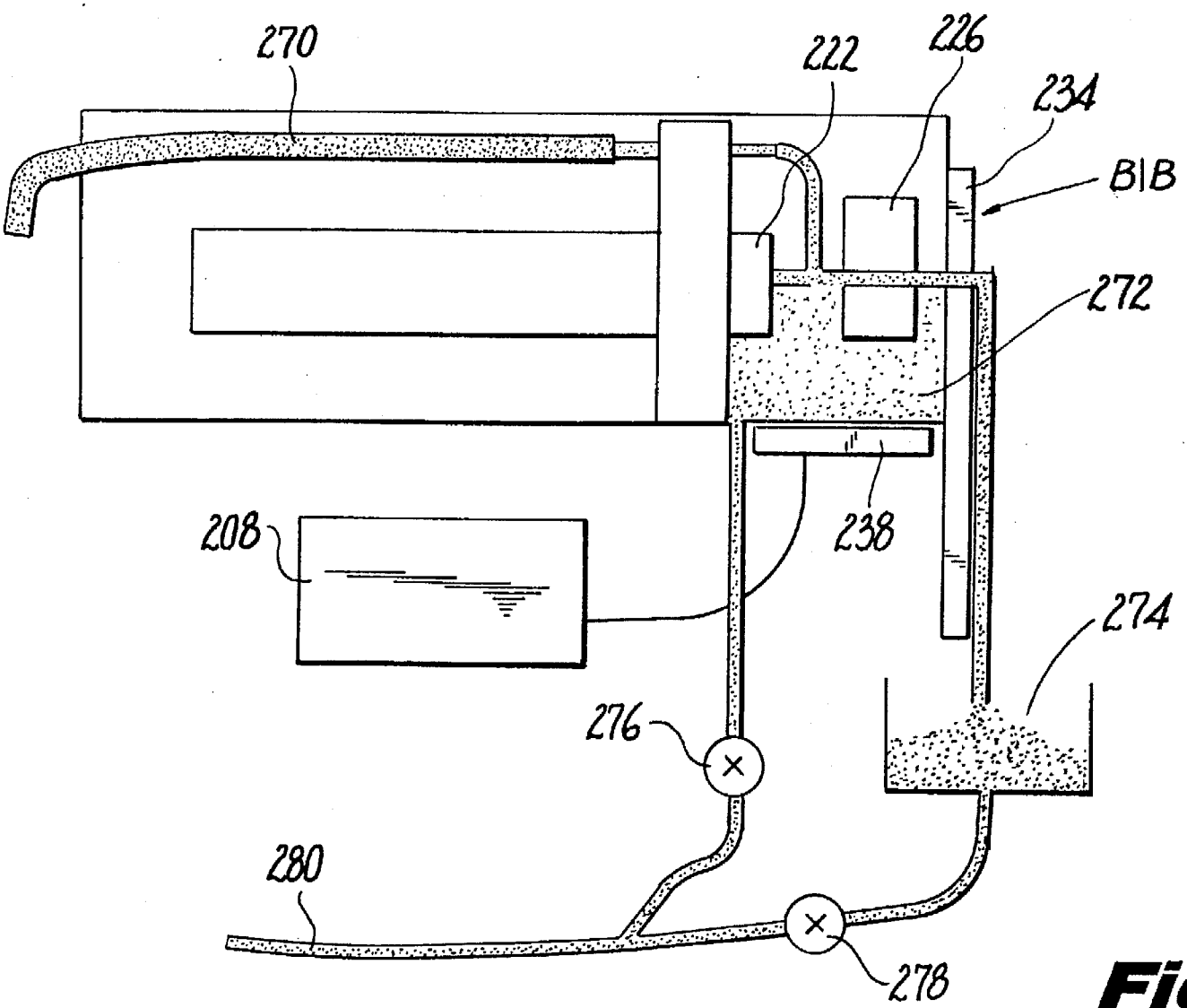
FIG. 14 is a concept level illustration of apparatus for ultrasonic cleaning of the printhead in accordance with a preferred embodiment of the present invention.

Reference is now made to FIG. 14 which is a conceptual illustration of ultrasonic cleaning of the printhead and shows supply of cleaning fluid via a conduit 270 from cleaning fluid container 30 (FIG. 2) to a cleaning bath 272 in which the printhead elements are immersed and with which is associated a piezoelectric ultrasound crystal 238 driven by driver assembly 208. Vibration of crystal 238 is operative to dislodge contaminants from elements in the printhead module and to suspend them in cleaning fluid. Cleaning fluid is drawn from bath 272 and from an overflow collector 274 via a pair of valves 276 and 278 respectively and a conduit 280, which communicates with cleaning fluid container 30.

Preferably the cleaning function is pre-programmed and operates once per day. The crystal 238 typically operates at 40 KHz.

Figure 15:
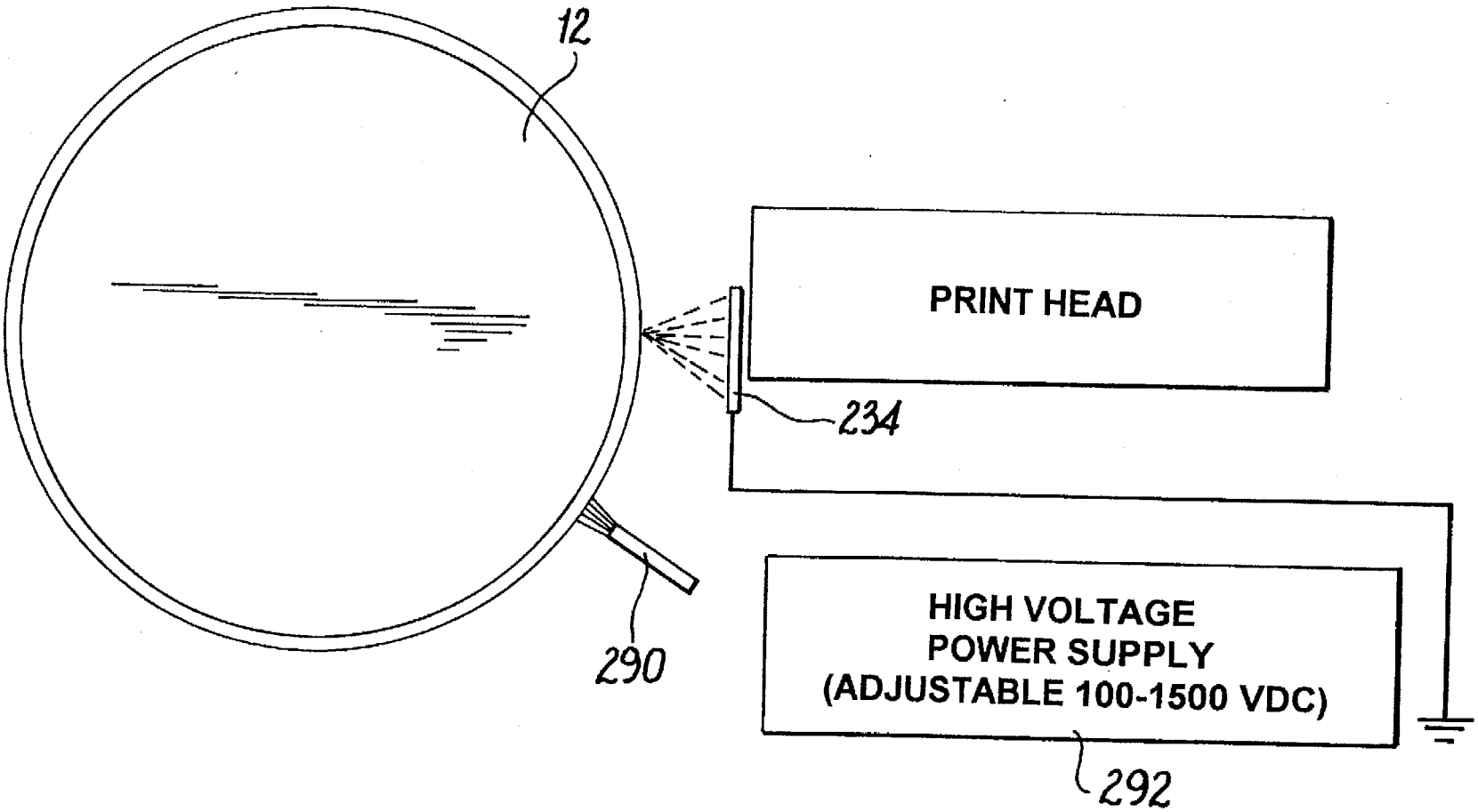
FIG. 15 is a concept level illustration of ink jet mist control apparatus provided in accordance with a preferred embodiment of the present invention.

Reference is now made to FIG. 15, which illustrates ink jet mist control apparatus operative in accordance with a preferred embodiment of the present invention. Preferably, the drum 12 is charged to a high voltage, such as +750 volt, by means of a charging brush 290 coupled to a high voltage power supply 292. Mist bib 234 is preferably grounded to define a mist shield.

It will be appreciated by persons skilled in the art that the present invention is not limited by what has been particularly shown and described hereinabove. Rather the scope of the invention is defined only by the claims which follow:

We claim:

1. Ink jet printing apparatus comprising:

a printing substrate cassette containing a multiplicity of printing substrates in rolled cut sheet form, said multiplicity of printing substrates being arranged in said cassette such that one edge of each substrate is exposed to permit automatic feeding thereof;

automatic paper feeding apparatus cooperative with said cassette for automatic feeding of printing substrates into said printing position;

an ink jet head assembly operative to print on said printing substrates at said printing position; and an ink supply assembly operative to provide ink to said ink jet head assembly.

2. Apparatus according to claim 1 and also comprising a generally cylindrical printing substrate support for positioning said substrates at said printing position.

3. Apparatus according to claim 1 and wherein the ink jet printing apparatus includes a cleaning assembly for automatically cleaning the ink jet head assembly.

4. Apparatus according to claim 3 and wherein said cleaning assembly includes an ultrasonic cleaning bath in which deflection electrodes are located.

5. Apparatus according to claim 3 and wherein said ink jet head assembly includes a plurality of ink jet nozzles producing a plurality of horizontally extending drop streams, a deflection assembly comprising a drop charging tunnel for each of the plurality of generally horizontally extending drop streams and a deflection electrode arranged intermediate each of said plurality of horizontally extending drop streams in a horizontal plane, such that in a horizontal plane, alongside each horizontally extending drop stream there are present a pair of electrodes.

6. Apparatus according to claim 5 and also comprising a drop collector having a knife edge angled with respect to the horizontal.

7. Apparatus according to claim 6 and wherein said cleaning assembly includes an ultrasonic cleaning bath in which deflection electrodes are located.

8. Apparatus according to claim 6 and wherein the charging tunnel, the knife edge and the nozzle are all located in the ultrasonic cleaning bath simultaneously.

9. Apparatus according to claim 3 and wherein the ink jet head assembly includes a drop collector defining an inclined knife edge impinging on the horizontal drop stream and defining an edge which is slanted in a plane perpendicular to the stream, whereby vertical adjustment of the position of the knife automatically produces horizontal adjustment thereof.

10. Apparatus according to claim 1 and also comprising waste collecting apparatus including vacuum generating apparatus.

11. Apparatus according to claim 1 and also comprising out ink sensing apparatus.

12. Apparatus according to claim 1 and also comprising apparatus for automatically calibrating the ink jet head assembly.

13. Apparatus according to claim 1 and wherein the ink jet head assembly includes a drop collector defining an inclined knife edge impinging on the horizontal drop stream and defining an edge which is slanted in a plane perpendicular to the stream, whereby vertical adjustment of the position of the knife automatically produces horizontal adjustment thereof.

14. Apparatus according to claim 1 and wherein said ink jet head assembly includes a plurality of ink jet nozzles producing a plurality of horizontally extending drop streams, a deflection assembly comprising a drop charging tunnel for each of the plurality of generally horizontally extending drop streams and a deflection electrode arranged intermediate each of said plurality of horizontally extending drop streams in a horizontal plane, such that in a horizontal plane, alongside each horizontally extending drop stream there are present a pair of electrodes.

15. Ink jet printing apparatus according to claim 1 and wherein said ink supply assembly comprises a flexible ink container including a septum filter for filtering ink removed therefrom.

16. Ink jet printing apparatus according to claim 15 and wherein said flexible ink container includes an active component for identifying the contents of the container.

17. An ink jet head assembly including:

a plurality of ink jet nozzles producing a plurality of horizontally extending drop streams, a deflection assembly comprising a drop charging tunnel for each of the plurality of generally horizontally extending drop streams and a deflection electrode arranged between each of said plurality of horizontally extending drop streams in a horizontal plane such that in a horizontal plane alongside each horizontally extending drop stream there are present a pair of electrodes and a drop collector having a knife edge angled with respect to the horizontal in a plane perpendicular to the stream.

18. A continuous ink jet head assembly comprising:

a plurality of ink jet nozzles, each arranged to output ink of either a different color or a similar color of either different or similar densities; and a mount for mechanically fixing the plurality of ink jet nozzles to a base, so as to substantially prevent relative mechanical displacement therebetween,.

and wherein the ink jet head assembly includes a drop collector defining an inclined knife edge impinging on the horizontal drop stream and defining an edge which is slanted in a plane perpendicular to the stream, whereby vertical adjustment of the position of the knife automatically produces horizontal adjustment thereof.

19. An ink jet head assembly including a plurality of ink jets and a deflection assembly comprising shared deflection electrodes and wherein the ink jet head assembly includes a drop collector defining an inclined knife edge impinging on the horizontal drop stream and defining an edge which is slanted in a plane perpendicular to the stream, whereby vertical adjustment of the position of the knife automatically produces horizontal adjustment thereof.

20. A printing substrate cassette including a housing having a rolled substrate support portion and a planar edge support portion for containing a multiplicity of printing substrates arranged in rolled cut sheet form wherein one edge of each of said multiplicity of printing substrates lies substantially flat and is exposed to a degree and in a manner which enables automatic feeding thereof.

21. A printing substrate cassette including:

a housing having a rolled substrate support portion and a planar edge support portion for containing a multiplicity of printing substrates arranged in rolled cut sheet form wherein one edge of each of said multiplicity of printing substrates lies substantially flat and is exposed to a degree and in a manner which enables automatic feeding thereof; and an active component associated with the housing for identifying the contents of the cassette.

22. An ink jet head assembly including a drop collector defining an inclined knife edge impinging on a horizontal drop stream and defining an edge which is slanted in a plane perpendicular to the stream, whereby vertical adjustment of the position of the knife edge automatically produces horizontal adjustment thereof.

* * * * *